US005212100A

United States Patent [19]

Groves et al.

[11] Patent Number: 5,212,100

[45] Date of Patent: May 18, 1993

[54] P-WELL CMOS PROCESS USING NEUTRON ACTIVATED DOPED N−/N+ SILICON SUBSTRATES

[75] Inventors: Emily A. Groves, Sachse; Gary J. Grant, Plano, both of Tex.

[73] Assignee: Texas Instruments Incorporated, Dallas, Tex.

[21] Appl. No.: 802,164

[22] Filed: Dec. 4, 1991

[51] Int. Cl.[5] ..... H01L 21/268

[52] U.S. Cl. ..... 437/17; 437/34; 148/DIG. 165

[58] Field of Search ..... 437/16, 17, 34, 45; 148/33, DIG. 165; 357/91; 376/183

[56] References Cited

U.S. PATENT DOCUMENTS

| | | | |
|---|---|---|---|
| 3,967,982 | 7/1976 | Arndt et al. | 437/17 |
| 4,684,413 | 8/1987 | Goodman et al. | 437/17 |
| 4,910,156 | 3/1990 | Takasu et al. | 437/17 |

FOREIGN PATENT DOCUMENTS

| | | | |
|---|---|---|---|
| 0120131 | 9/1980 | Japan | 148/DIG. 165 |

OTHER PUBLICATIONS

Prussin et al., "Application of Neutron Transmutation Doping for Production of Homogeneous Epitaxial Layers", J. of Electrochemical Society, vol. 125, No. 2, pp. 350–352, Feb. 1978.

*Primary Examiner*—Brian E. Hearn
*Assistant Examiner*—C. Chaudhari
*Attorney, Agent, or Firm*—René E. Grossman; Richard L. Donaldson

[57] ABSTRACT

About 6 to 20 micrometer resistivity N− (600 ohm-cm and above) silicon is epitaxially deposited on N+ (0.01 to 0.1 ohm-cm) substrates. The resistivity of the epitaxial layer is lowered to 5 to 60 ohm-cm using neutron activated doping. A 1 micrometer p-well process is utilized to build natural (unadjusted) PMOS transistors in the bulk silicon. These transistors operate in the subthreshold region where the threshold or turn on voltages have to match closely across a large device. N-channel transistors are fabricated in a P-well. The advantage of using neutron activated doped silicon is that the carrier concentration is very uniform and therefore threshold variations are much smaller than in transistors built in conventional doped silicon. The use of a neutron doped epitaxial layer on a P-well CMOS process provides a novel approach to control dopant uniformity and thus uniform transistor characteristics as well as providing a heavily doped conventional substrate to enhance resistance to CMOS latch-up.

4 Claims, 6 Drawing Sheets

P-WELL CMOS PROCESS USING NEUTRON ACTIVATED DOPED N−/N+ SILICON SUBSTRATES

BACKGROUND OF THE INVENTION

1. Field of the Invention

This invention relates to a method of making semiconductor devices and primarily CMOS devices using neutron activated doped silicon substrates and the devices resulting therefrom.

2. Brief Description of the Prior Art

Transistors operating in the subthreshold region are finding increasing importance for large area focal plane array (FPA) processors. Subthreshold transistors draw very little current. Therefore very large area devices can be fabricated which will use lower power. However, subthreshold transistors fabricated using conventional doped silicon techniques are unable to maintain highly uniform threshold voltages from device to device in the circuit. This is a problem where Class A amplifiers are used in such circuits wherein the transistor threshold voltages must match very closely.

SUMMARY OF THE INVENTION

In accordance with the present invention, it has been found that the variation in threshold voltage in p-channel transistors built in n− epitaxially deposited neutron doped silicon is more uniform than transistors built in conventional doped silicon. Neutron doped silicon is known in the art, such doping techniques being set forth in an article entitled "Application of Neutron Transmutation Doping for Production of Homogeneous Epitaxial Layers" by S. Prussin and J. W. Cleland, Journal of the Electrochemical Society, Volume 125, part 1, pages 350–352, the contents of which are incorporated herein by reference.

More specifically, about 6 to 20 micrometer thick high resistivity N− (600 ohm-cm and above) silicon is epitaxially deposited on N+ (0.01 to 0.1 ohm-cm) substrates. The resistivity of the epitaxial layer is lowered to 5 to 60 ohm-cm using neutron activated doping. A p-well process is utilized to build natural (unadjusted) PMOS transistors in the bulk silicon. These transistors operate in the subthreshold region where the threshold or turn on voltages have to match closely across a large device. N-channel transistors are fabricated in a P-well. The advantage of using neutron activated doped silicon is that the carrier concentration is very uniform and therefore threshold variations are much smaller than in transistors built in conventional doped silicon. The use of a neutron doped epitaxial layer in a P-well CMOS process provides a novel approach to control dopant uniformity and thus uniform transistor characteristics as well as providing a heavily doped conventional substrate to enhance resistance to CMOS latch-up.

DESCRIPTION OF THE PREFERRED EMBODIMENT

Figure 1:
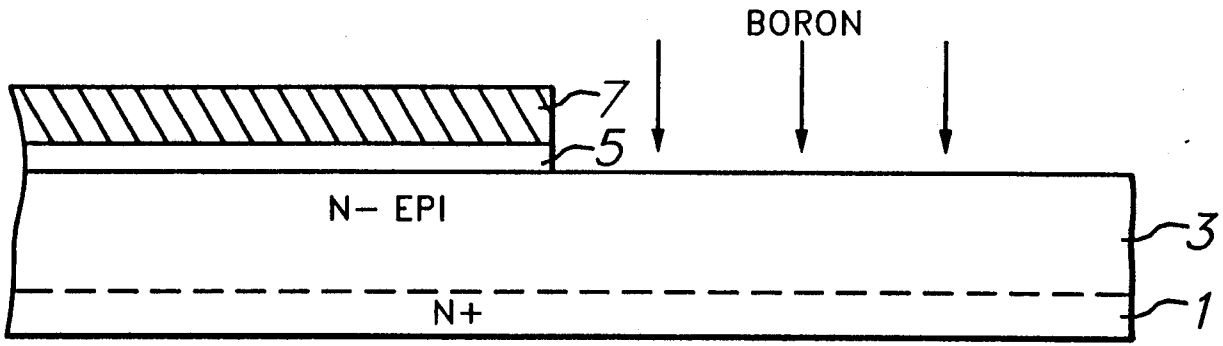
FIGS. 1 to 11 are a flow diagram of the processing steps required to fabricate a CMOS device in accordance with the present invention.
Figure 2:
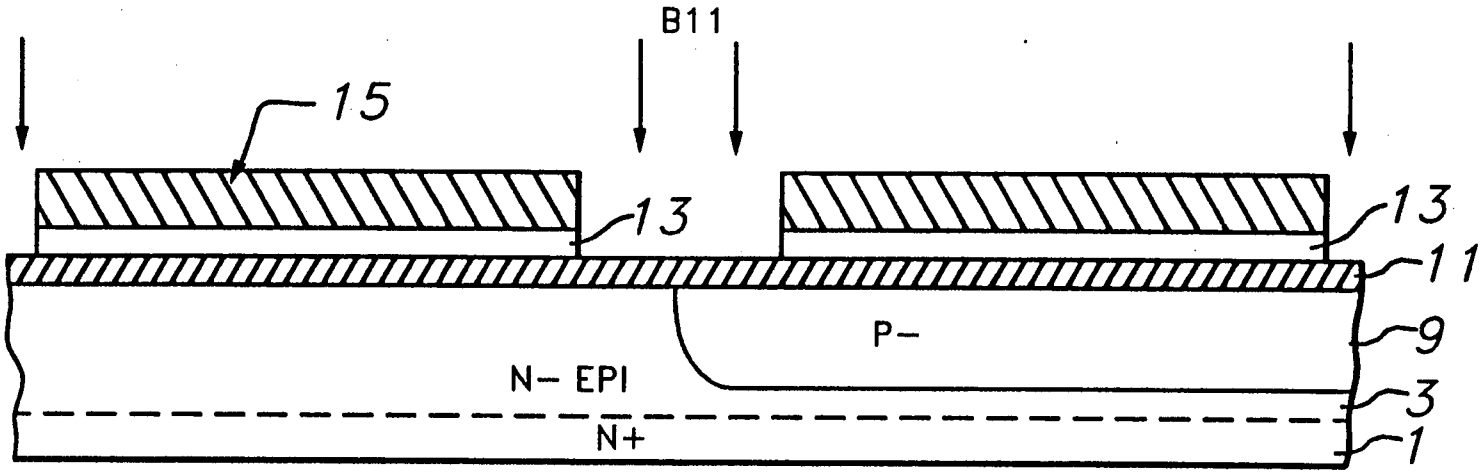

Referring now to FIG. 1, there is provided an N+ substrate 1 having a resistivity of from 0.01 to 0.1 ohm-cm. A layer of intrinsic silicon about 5 to 20 microns thick, depending upon the application, is epitaxially deposited on the substrate 1 and the resistivity of the epitaxial layer 3 is then lowered to about 5 to 60 ohm-cm using neutron activation as set forth, for example, in the Prussin et al. paper noted above. The neutron activation also converts the epitaxial layer 3 to N-type. A silicon dioxide layer 5 of about 8000 Angstroms is then formed by oxidation of the silicon layer 3, a photoresist layer 7 is formed on the layer 5 and patterned and etched in conventional manner and boron is then implanted into the unmasked portion of the layer 5 to form a P-type tank 9 as shown in FIG. 2.

Figure 3:
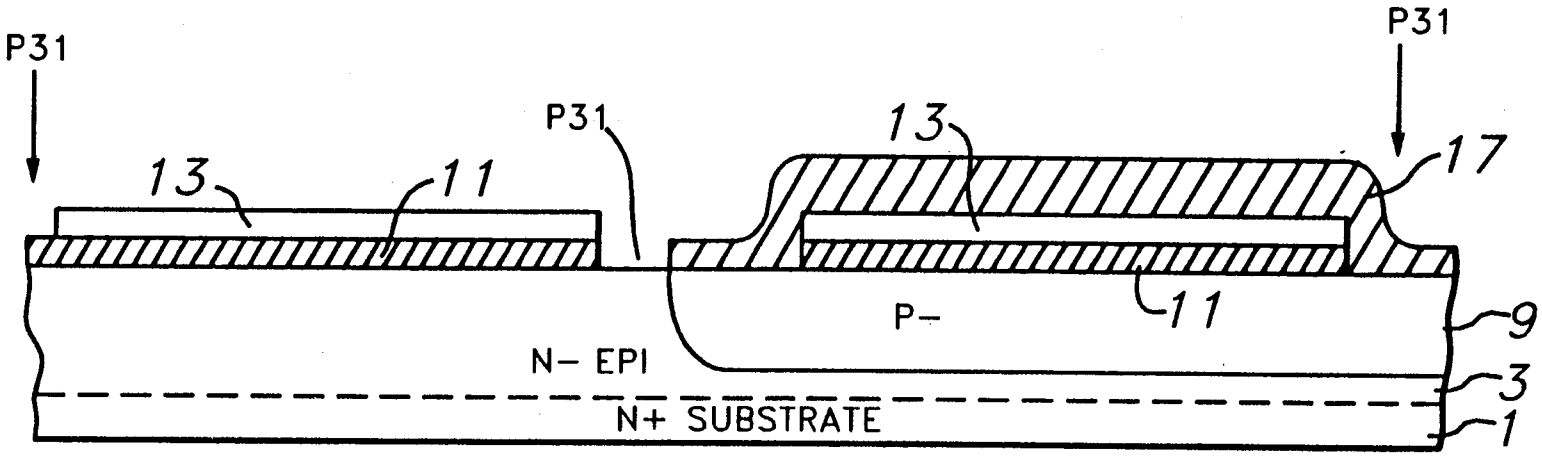

The oxide layer 5 and photoresist 7 are then removed and the exposed surface is that oxidized to provide a layer of silicon dioxide II having a thickness of 500 Angstroms. A layer of silicon nitride 13 having a thickness of about 1400 Angstroms is then deposited over the silicon dioxide layer 11, a layer of photoresist 15 is formed thereover and patterned and the exposed portion of the nitride layer 13 is then etched down to the silicon dioxide layer 11, all in a standard manner. A blanket boron channel stop is then implanted with a dose of $1\times10^{13}/cm^2$ of boron 11 at 100 KEV in the region from which the silicon nitride was etched. The layer of photoresist 15 is then removed, the exposed portion of the silicon dioxide layer 11 is etched away and a new layer of photoresist 17 is formed and patterned to cover the exposed portion of the P-tank 9, all in standard manner. The exposed regions of the epitaxial layer 3 are then doped with phosphorous 31 doses at 50 KEV as shown in FIG. 3. This is required to increase P-channel thick field threshold voltage.

Figure 4:
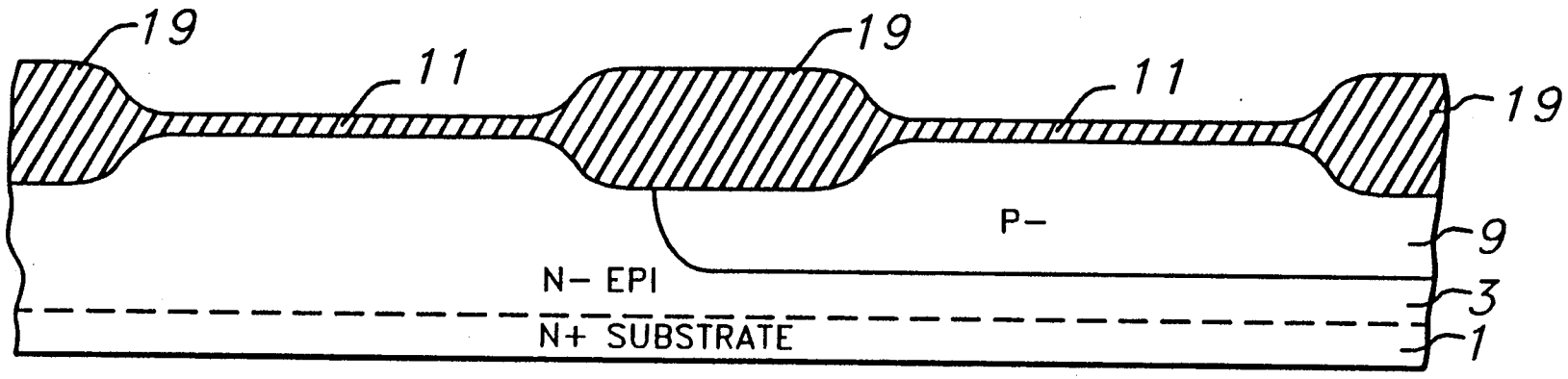
Figure 5:
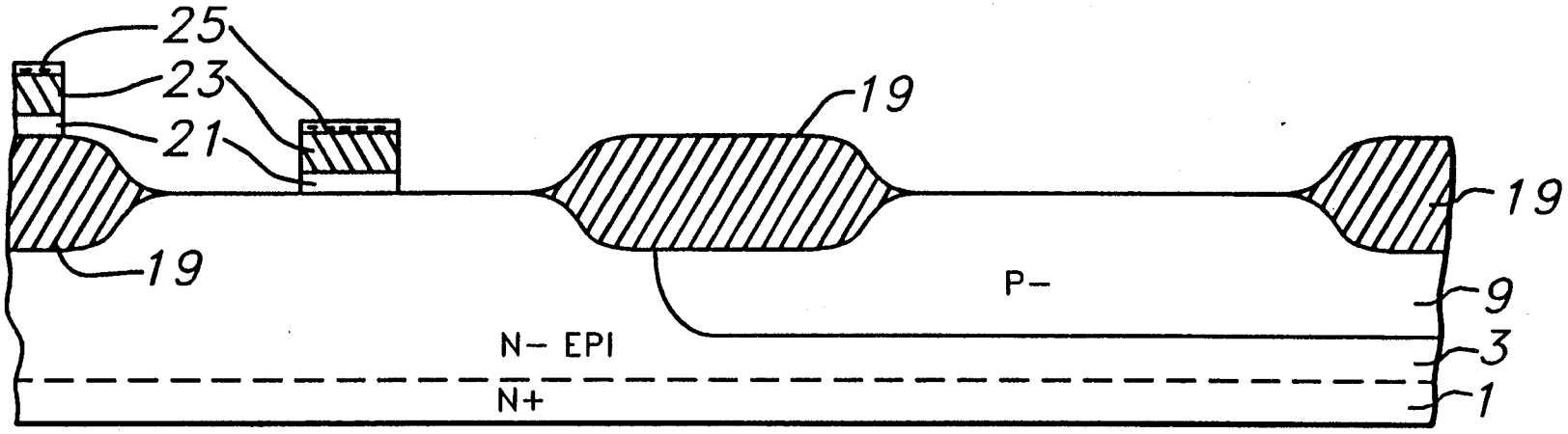

The photoresist 17 is stripped and the surface is oxidized in the regions not masked by the nitride layer 13 to provide a 7 micrometer (7000 Angstrom) field oxide 19 as shown in FIG. 4. The nitride layer 13 is then removed, the silicon dioxide layer 11 is then etched away in standard manner and a 250 Angstrom pregate oxide is thermally grown in the exposed silicon areas. The pregate oxide is then etched away and a 200 Angstrom first gate oxide 21 is grown in the moat region over the epitaxial layer 3 and over the field oxide 19. A 5000 Angstrom chemical vapor deposition (CVD) layer of polysilicon 23 is then deposited over the oxide layer 21 and a $POCl_3$ deposition then takes place in formation of the gate electrode. The surface of the device is then deglazed and a 400 Angstrom layer of silicon nitride 25 is formed over the polysilicon by CVD. The nitride layer 25 and polysilicon layer 23 are then patterned and etched to provide the structure as shown in FIG. 5 to complete formation of the first gate electrodes and the bottom plates of capacitors.

Figure 6:
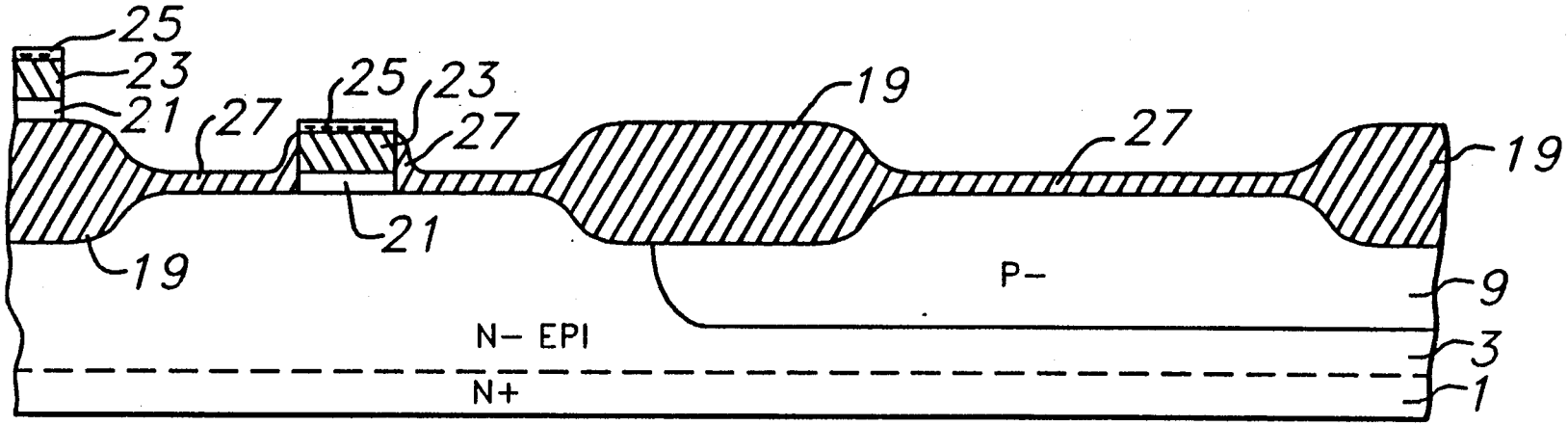
Figure 7:
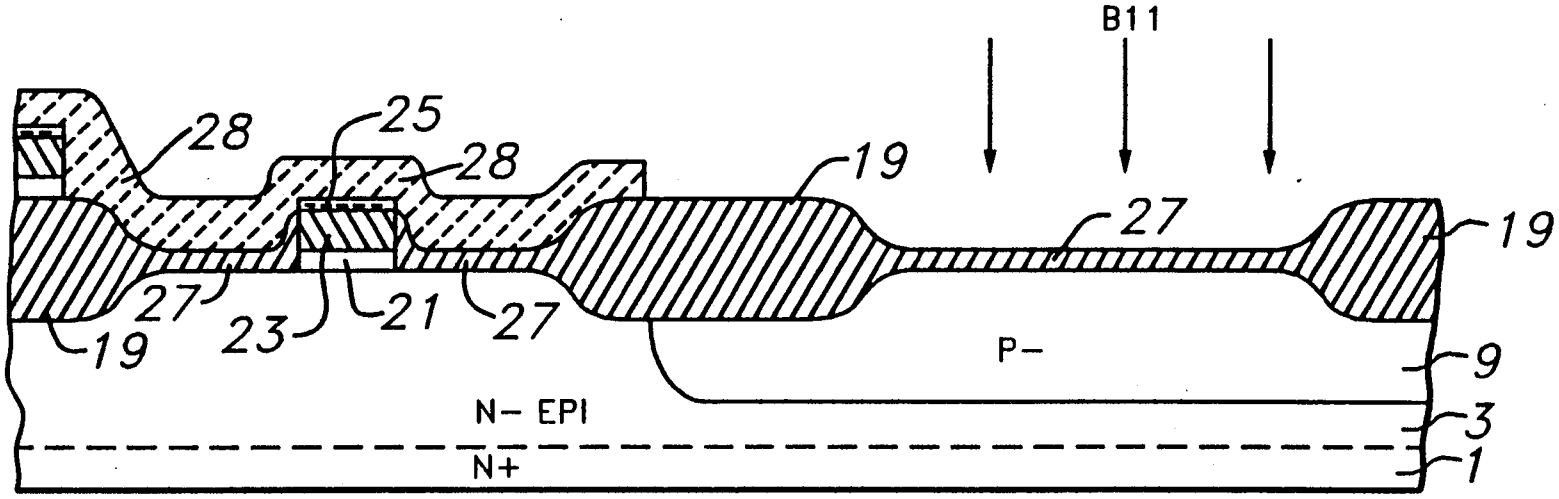

A 200 Angstrom second gate silicon dioxide layer 27 is then grown as shown in FIG. 6, this oxide layer extending along the sidewalls of the oxide layer 21, polysilicon layer 23 and nitride layer 25 of the gate portion in the center of the moat as shown in FIG. 6. A photoresist layer 28 is then formed over the device and patterned to expose the P-tank 9 with oxide layer 27 thereover as shown in FIG. 7. Boron is then implanted into the P-tank region 9 for the V, threshold adjust to adjust the n-channel threshold to a reasonable operating level, about 0.8 volts. The photoresist layer 28 is then conventionally stripped in standard manner.

Figure 8:
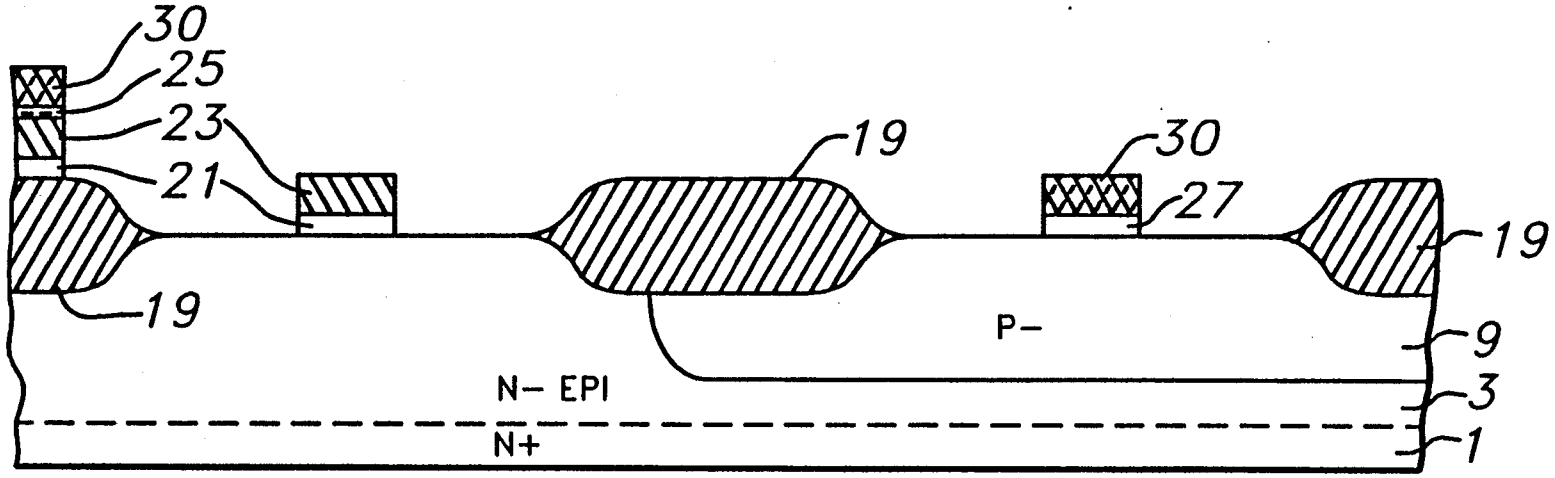

A 3000 Angstrom second polysilicon layer 29 is formed over the device. A phosphorous deposition of $POCl_3$ then takes place to dope the gate electrode with subsequent deglaze of the surface. A photoresist is again deposited and patterned with isotropic etching of the second polysilicon layer resulting in polysilicon 29 over the oxide layer 27 and the nitride layer 23 over the field oxide 19. This forms the second gate dielectric and the top plates of the capacitors extending down to the silicon in the moat regions. The photoresist is stripped and the device surface is deglazed as shown in FIG. 8.

Figure 9:
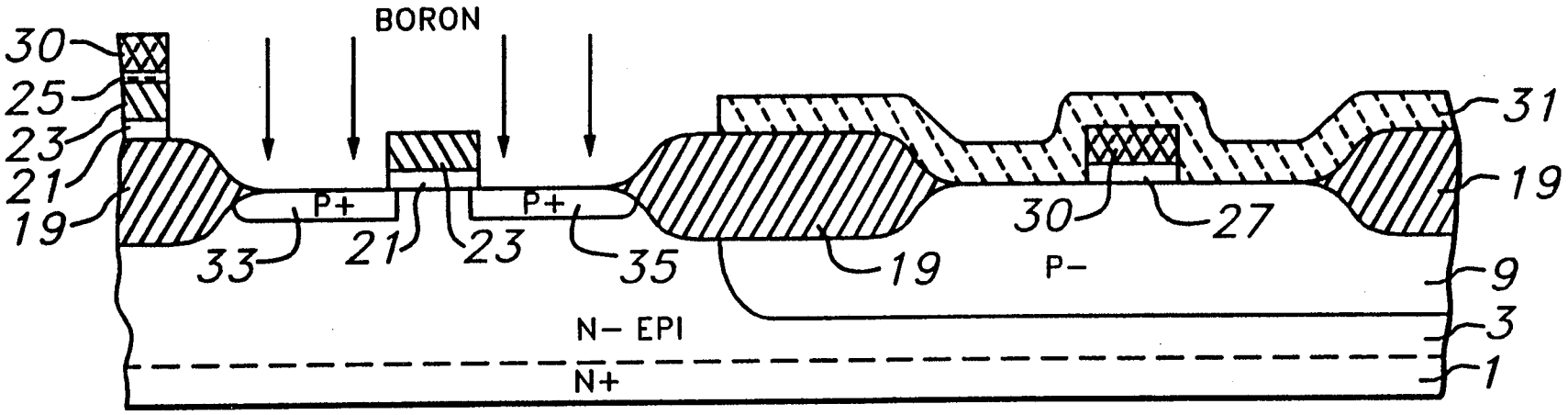

A photoresist 31 is formed over the device and patterned and boron is implanted in the exposed regions which are in the layer 3 to form source 33 and drain 35 regions of a P-channel device as shown in FIG. 9. The photoresist layer 31 is then stripped and the device is implanted and annealed, all in standard manner.

Figure 10:
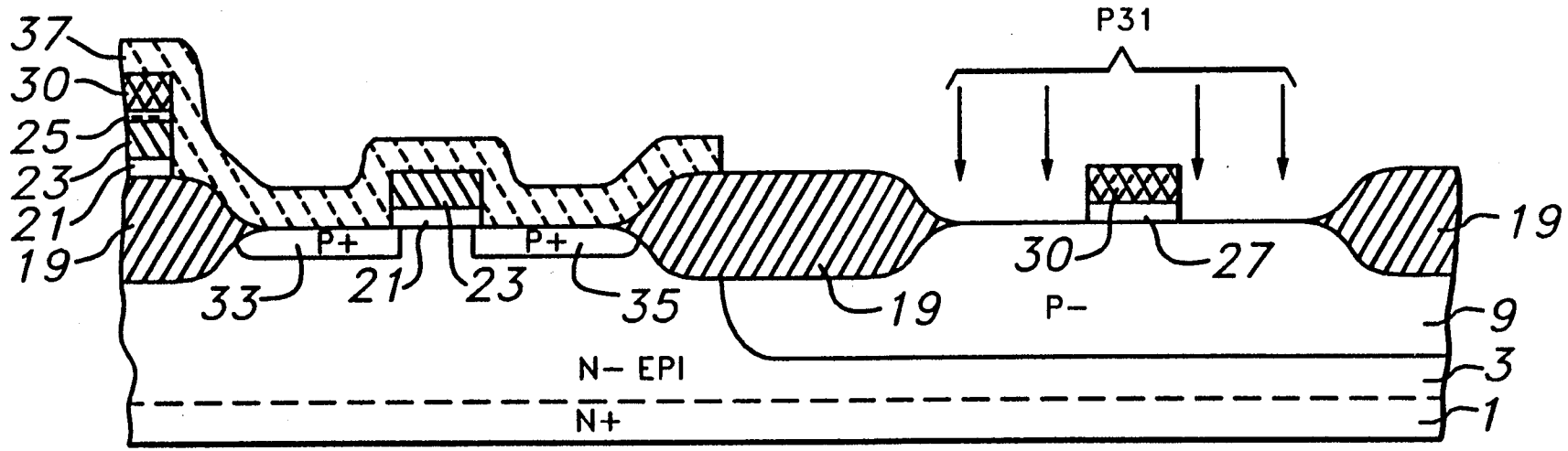
Figure 11:
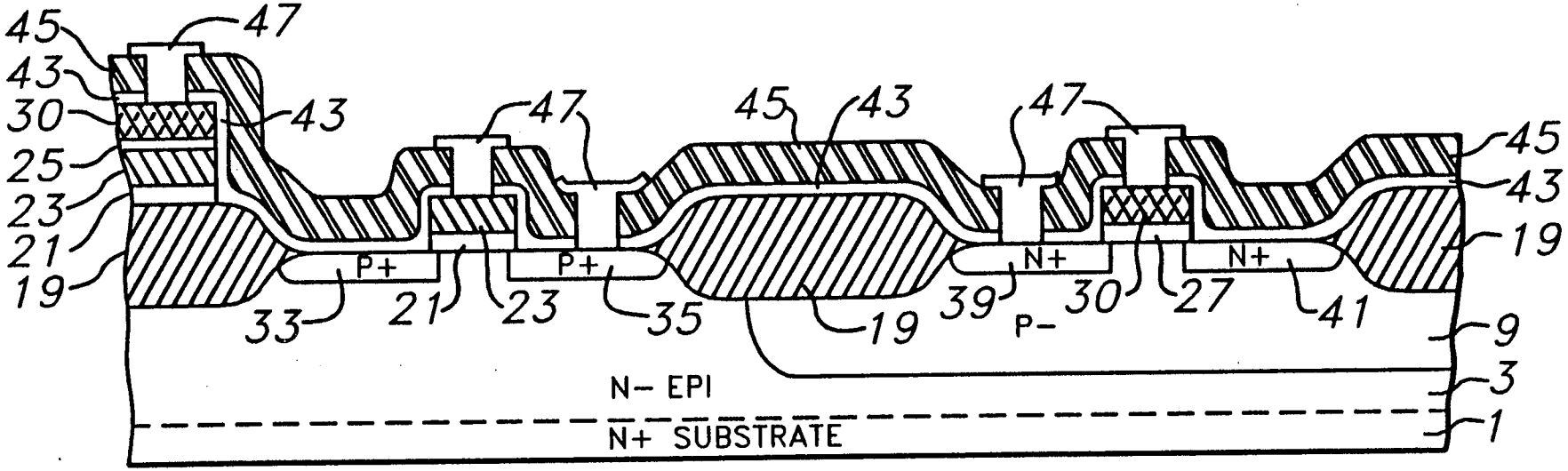

A photoresist 37 is formed over the device and patterned and phosphorous is implanted in the exposed regions which are in the P-tank 9 to form source 39 and drain 41 regions of an N-channel device as shown in FIG. 10. The photoresist 37 is then stripped and a 1500 Angstrom plasma oxide 43 is then formed over the surface of the device. An implant anneal for the N-channel device source and drain are performed in standard manner. A 7000 Angstrom layer of phosphorous silicate glass (PSG) 45 is then deposited over the oxide 43 and leached and reflowed to planarize the glass in standard manner. Apertures for contacts are then patterned and etched through the oxide layer 43 and glass layer 45. Ti-W-Al2%Cu 47 is then sputtered and patterned through a mask to provide connection to the gate, source and drain regions and contacts on to the polysilicon layer 29 over the field oxide 19 in standard manner as shown in FIG. 11. The device is then dry metal etched and sintered and an overcoat of 3000 Angstroms of silicon nitride and 10,000 Angstroms of silicon dioxide is deposited in standard manner, patterned and etched to provide the final structure.

The structure provided in accordance with the above described fabrication process for p-channel transistors which are built in n-epitaxially deposited neutron doped silicon demonstrates a variation in threshold voltage which is more uniform than transistors built in conventional doped silicon.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. A method of fabricating a semiconductor structure, comprising the steps of:

(a) providing a substrate;

(b) forming a layer of neutron activated semiconductor material on said substrate by depositing a substantially intrinsic layer of said semiconductor material on said substrate and then bombarding said layer of intrinsic semiconductor material with neutrons to provide a uniform N-type dopant therein and decrease the resistivity thereof; and (c) forming semiconductor devices in said neutron activated layer by forming a P-well in said layer of neutron activated semiconductor material, forming an N-channel device in said P-well and forming a P-channel device in said layer of neutron activated semiconductor material external to said P-well.

2. The method of claim 1 wherein said substrate and said layer of neutron activated semiconductor material are both N-type silicon.

3. The method of claim 1 wherein said neutron activated semiconductor material has a resistivity of from about 5 to about 60 ohm-cm and said substrate has a resistivity of from about 0.01 to about 0.1 ohm-cm.

4. The method of claim 2 wherein said neutron activated semiconductor material has a resistivity of from about 5 to about 60 ohm-cm and said substrate has a resistivity of from about 0.01 to about 0.1 ohm-cm.

* * * * *